US012053018B2

(12) United States Patent
Williams

(10) Patent No.: US 12,053,018 B2
(45) Date of Patent: Aug. 6, 2024

(54) WATER-ASSISTED SMOKING APPARATUS AND METHOD OF USE

(71) Applicant: Minjoe Williams, Nutley, NJ (US)

(72) Inventor: Minjoe Williams, Nutley, NJ (US)

( * ) Notice: Subject to any disclaimer, the term of this patent is extended or adjusted under 35 U.S.C. 154(b) by 118 days.

(21) Appl. No.: 16/479,833

(22) PCT Filed: Jan. 24, 2018

(86) PCT No.: PCT/US2018/015005
§ 371 (c)(1),
(2) Date: Jul. 23, 2019

(87) PCT Pub. No.: WO2018/140467
PCT Pub. Date: Aug. 2, 2018

(65) Prior Publication Data

US 2020/0229491 A1 Jul. 23, 2020

Related U.S. Application Data

(60) Provisional application No. 62/450,015, filed on Jan. 24, 2017.

(51) Int. Cl.
*A24F 1/30* (2006.01)
*A24F 1/14* (2006.01)

(52) U.S. Cl.
CPC . *A24F 1/30* (2013.01); *A24F 1/14* (2013.01)

(58) Field of Classification Search
None
See application file for complete search history.

(56) References Cited

U.S. PATENT DOCUMENTS

| | | | | |
|---|---|---|---|---|
| 4,140,138 | A * | 2/1979 | Keller | A24F 1/30 131/194 |
| 10,342,255 | B2 * | 7/2019 | Huston | A24F 1/30 |
| 2008/0072917 | A1 * | 3/2008 | Lee | A24F 1/30 131/330 |
| 2018/0070629 | A1 * | 3/2018 | Hemphill | A61M 16/14 |
| 2018/0070630 | A1 * | 3/2018 | Huston | A24F 1/30 |

* cited by examiner

*Primary Examiner* — Philip Y Louie
*Assistant Examiner* — Jeffrey A. Buckman
(74) *Attorney, Agent, or Firm* — Michael J. Feigin, Esq.; Feigin and Fridman LLC

(57) ABSTRACT

A water-assisted smoking apparatus is provided having two chambers in substantially vertical alignment and separated by a choke point. Each chamber has at least two vents configured to be sealed with a plug or with a smoke generating and conveying assembly that holds a quantity of a combustible substance and conveys smoke therefrom into the upper chamber through suction generated by the apparatus. The apparatus is operable with a quantity of liquid and controlled venting to draw in and collect smoke generated from burning of the combustible substance in both a first orientation in which the first chamber is the upper chamber and the second chamber is the lower chamber and also when the apparatus is inverted to a second orientation in which the second chamber is the upper chamber and the first chamber is the lower chamber.

5 Claims, 12 Drawing Sheets

WATER-ASSISTED SMOKING APPARATUS AND METHOD OF USE

This application claims the priority of U.S. Provisional Ser. No. 62/450,015, filed Jan. 24, 2017.

BACKGROUND OF THE INVENTION

Field of the Invention

The present invention is related to the field of smoking and, more particularly, to an invertible water-assisted smoking apparatus having two chambers that uses the force of gravity and controlled venting to cause water to fall from the upper chamber into the lower chamber while simultaneously drawing smoke into the upper chamber for inhalation by the user.

Description of the Related Art

Water-assisted smoking devices by which the user inhales smoke that has passed through a quantity of water are known to lower the temperature of the smoke and make the smoke smoother on the throat as compared with the hotter and drier smoke that is inhaled directly from a cigarette or pipe. Upon igniting a desired quantity of herb or other combustible substance to be smoked, many conventional water-assisted smoking devices rely on suction created by inhalation through the user's mouth to draw smoke through the water and into a collecting area of the device. This non-standardized method of suction may, of course, vary from user to user and can be difficult in practice for some individuals, such as those who may have limited proficiency with smoking tools.

One approach to solving the suction problem is set forth in U.S. Publ. No. 2008/0072917 which discloses a smoking tool having a smoke collecting chamber, a control valve beneath the smoke collecting chamber and a filtering agent collecting chamber positioned below the valve. While herbs are combusted adjacent an opening in the smoke collecting chamber, filtering agent in the smoke collecting chamber is allowed to flow into the collecting chamber by opening the valve in a controlled manner which creates suction that draws smoke into the smoke collecting chamber where the smoke is held for subsequent inhalation. To reuse the device the collecting chamber must be removed and the filtering agent either reused or replaced with a fresh amount of filtering agent which is poured into the smoke collecting chamber. Refilling the smoke collecting chamber with filtering agent after each use of the device is time consuming and can be messy.

Therefore, a need exists for a smoking apparatus that provides the benefits of suction produced by the apparatus while easily providing for repeated reuse of the apparatus as soon as the previous use is completed without requiring the user to disassemble the apparatus and then manually empty one chamber and refill another chamber with water before the apparatus can be used again.

SUMMARY OF THE INVENTION

In view of the foregoing, the present invention is directed to a water-assisted smoking apparatus having two chambers that are in substantially vertical alignment with one another and separated by a small opening or choke point through which fluid can pass from the upper chamber to the lower chamber. Optionally, the choke point may include a valve.

The outer end of each chamber, with "outer" being the side opposite the choke point, may be provided with a plurality of feet or legs in spaced relationship that will allow the apparatus to stand in an upright orientation when placed on a generally horizontal support surface with either of the two chambers in the lower position. Alternatively, in the absence of feet the lower chamber may be supported by a perch that cradles the lower chamber or, as a further alternative structure, an end vent closing element used with the apparatus may cooperate with or be part of a base that allows the apparatus to stand on a pedestal when the end vent closing element is in place within the end vent. In any of these or other suitable arrangements, which of the chambers is the "upper" chamber and which is the "lower" chamber is merely a function of the orientation of the apparatus for any given use, as the apparatus is fully and interchangeably invertible, and preferably symmetrical.

Each chamber has at least one side vent fitted with a removable sealing vent cap or plug and a further vent or opening in the outer end. With the apparatus standing in an upright orientation using either feet or a cradling perch, the outer end opening of the upper chamber, or top opening, may be fitted with either a removable solid plug or a sealing member that is configured for use with a bowl having an opening in the bottom. The opening may be formed as part of a stem which may be of various lengths. The stem has a central bore or channel running the length thereof like a straw. The sealing member closes the top opening but has a central bore through which the stem is inserted. The stem fits snugly in the bore of the sealing member to ensure that air can only enter the upper chamber through the stem. The bowl, which is positioned above the sealing member and is preferably integral with the stem, serves to hold the quantity of herb or other combustible substance that is to be ignited to generate smoke.

As an alternative to the sealing member and stemmed bowl, the apparatus may be configured to have the top opening, as well as a corresponding bottom opening, closed with an end vent closing element. The end vent closing element, as just noted, is removably fitted into a base that forms a pedestal upon which the apparatus stands. The upper chamber may also be fitted with an end vent closing element and base structure so that both ends of the apparatus are symmetrical, each having the respective end opening sealed with an end vent closing element with associated base. Prior to use, the end vent closing element and base structure in the top opening is removed and a necked bowl is fitted into the top opening in place thereof. The inserting end or neck of the necked bowl has a channel therethrough for the passage of air and is sized to slide into the top opening in a same or similar manner as did the end vent closing element and preferably forms a unitary structure with the bowl.

When appropriate to facilitate the following description and claims, the combination of the sealing member and the stemmed bowl, as well as the alternative necked bowl, are each generically referred to herein as a "smoke generating and conveying assembly".

When the apparatus is in use in a first orientation, the chamber that is fitted with the smoke generating and conveying assembly in the outer end thereof is the "upper" chamber such that, as noted in the previous paragraph, the opening in the outer end of the upper chamber may be referred to herein as the top opening. When in this first orientation, the corresponding outer end opening in the lower chamber is referred to herein as the bottom opening and is sealed with the removable solid plug or with an end vent closing element and base. When the apparatus is inverted to a second orientation, where the upper chamber becomes the lower chamber and vice versa, the removable plug, or end vent closing element and base is replaced with the smoke generating and conveying assembly while the outer end or bottom opening in the other chamber, now positioned as the lower chamber, is sealed with the removable solid plug or with the end vent closing element and base.

To describe the use of the apparatus according to the present invention, the chambers will be referred to as chamber A and chamber B, again with the understanding that either chamber may be the upper chamber or the lower chamber depending upon the orientation of the apparatus for any given use. Starting with chamber A as the lower chamber, a quantity of water is poured into chamber B through the top opening thereof with the side vent in chamber B being sealed, the bottom opening in chamber A having been sealed, and the side vent plug in chamber A having been removed. The force of gravity will cause the water to flow through the choke point and into the lower chamber A while the air previously in chamber A escapes through the open chamber A side vent. Once the desired amount of water has been introduced into the apparatus, the top opening in chamber B is sealed with the removable plug (or end vent closing element and base) and the side vent in chamber A is sealed with a vent plug.

The apparatus is then inverted so that chamber A is now the upper chamber and chamber B is the lower chamber. The solid plug (or end vent closing element and base) is removed from the top opening of chamber A and replaced with the smoke generating and conveying assembly. According to a preferred embodiment, the choke point is small enough so that, with the bottom opening and both side vents sealed, the water in the upper chamber A will not flow into the lower chamber B, being prevented from doing so by the air pressure in lower chamber B. Alternatively, in a second embodiment a valve is provided in the choke point which is closed before inverting the apparatus.

With the desired quantity of combustible substance in the bowl and the smoke generating and conveying assembly fitted in the top opening, the side vent plug in the lower chamber B is removed, allowing air in chamber B to escape through the open side vent, and the combustible substance is ignited. Venting of the air allows the water in chamber A to fall by gravity into chamber B through the choke point. This creates a partial vacuum in chamber A which draws air and smoke from the burning substance in through the central channel in the stem or neck of the smoke generating and conveying assembly. If the stem is long enough, the smoke will exit into the quantity of water still in the upper chamber, creating bubbles of smoke upon meeting the water and bursting when the bubbles meet the upper surface of the water to fill chamber A with smoke. With a short stem, the smoke enters the air-filled portion of the upper chamber above the water level. After the water has fully transferred from the upper chamber A into the lower chamber B of the apparatus, the smoke is contained in the vessel and may be inhaled preferably through the top opening (after removing the smoke generating and conveying assembly) or through either side vent.

Once the smoke has been inhaled, the process may be easily repeated by sealing the side vents and top opening with respective plugs (or with an end vent closing element and base in the top opening) and inverting the apparatus to place chamber B, now filled with water, in the upper chamber position. The plug (or end vent closing element and base) in the top opening (of chamber B) is then removed and replaced with the smoke generating and conveying assembly in which the bowl contains the desired quantity of combustible substance. Upon removal of the plug from the chamber A side vent and igniting of the substance in the bowl, smoke will be drawn into and collected in chamber B through the top opening, as fitted with the smoke generating and conveying assembly, as the water flows by gravity into chamber A. This inventive method allows for multiple repetitions without exchanging liquids.

Accordingly, it is an object of the present invention to provide a water-assisted smoking apparatus having two chambers that uses the force of gravity acting on a quantity of water to create a partial vacuum in the upper chamber that suctions smoke into the apparatus where it is collected and held for subsequent inhalation by the user, the two chambers being in generally vertical alignment with one another, the relationship of the two chambers by which one is the upper chamber and the other is the lower chamber being interchangeable between two orientations by inverting the apparatus such that the apparatus works effectively in either orientation to burn a combustible substance and, through an apparatus-generated vacuum, to draw in and collect the smoke that is generated when the substance is ignited.

Another object of the present invention is to provide a water-assisted smoking apparatus in accordance with the preceding objects in which the two chambers are separated by a choke point that, together with air trapped in the lower chamber, prevents a quantity of water trapped in the upper chamber from flowing into the air-filled lower chamber until a top opening in the upper chamber and a vent in the lower chamber are opened, venting of the lower chamber allowing the force of gravity to cause the water in the upper chamber to flow downwardly into the lower chamber while at the same time creating a partial vacuum in the upper chamber that draws in air through the opening in the upper chamber to support the burning of a combustible substance adjacent the opening while collecting the smoke therefrom in the upper chamber of the vessel.

A further object of the present invention is to provide a method of using a water-assisted smoking apparatus in accordance with the preceding objects in which the apparatus may be used in a first orientation in which one chamber designated chamber A, fitted with a smoke generating and conveying assembly and having a quantity of water therein, is on top and the other chamber filled with air and designated chamber B is on the bottom, upon venting of chamber B water flowing from chamber A into chamber B while a quantity of combustible substance within the smoke generating and conveying assembly associated with chamber A is burned so that smoke, drawn into the apparatus by a partial vacuum created by the controlled venting and the water transfer between the chambers, is collected in chamber A and then inhaled, after which the apparatus may be immediately inverted to place chamber B, now containing the water, on top and chamber A on the bottom, the smoke generating and conveying assembly with a quantity of combustible substance as now associated with chamber B being ignited so that while the water flows from chamber B into chamber A upon venting of chamber A, smoke is drawn into and collected in chamber B for inhalation by the user, the process of burning, collecting smoke through suction created by the apparatus, inhaling the smoke, and inverting the apparatus for reuse being repeatable multiple times without delay or any need to change the water.

A still further object of the present invention is to provide a water-assisted smoking apparatus and method in accordance with the preceding objects in which each chamber includes a plurality of vents at least some of which are sealable with an end vent closure element and base that is readily exchanged with a smoke generating and conveying assembly, the vent closure element and base adjacent a bottom vent serving to both seal the bottom vent and provide a pedestal to support the apparatus on a support surface when in use.

It is yet another object of the invention to provide a water-assisted smoking apparatus and method in accordance with the preceding objects that provides an easy, clean and efficient smoking experience by which smoke is drawn into the apparatus through the smoke generating and conveying assembly by a partial vacuum generated by the apparatus when in use so that the need for mouth-generated suction by the user to draw the smoke into the apparatus is eliminated.

Still another object of the present invention is to provide a liquid-assisted air-moving apparatus that includes a vessel having a first chamber and a second chamber in substantially vertical alignment with one another and separated by a choke point, each chamber having at least a first vent and a second vent with the vents having respective removable closing elements for sealing the vents, the apparatus being fully invertible and operable with a quantity of liquid to create suction to draw in air when in a first orientation with the first chamber as an upper chamber and the second chamber as a lower chamber and also being operable to draw in air when inverted to a second orientation in which the second chamber is the upper chamber and the first chamber is the lower chamber, liquid in the upper chamber being prevented from moving into the lower chamber by the choke point and air trapped in the lower chamber when the lower chamber is sealed, and the air being drawn into the apparatus by movement of the liquid from the upper chamber to the lower chamber when the upper and lower chambers are vented.

Still another object of the invention is to provide a water-assisted smoking apparatus and method in accordance with the preceding objects in which the smoke generating and conveying assembly includes a bowl with a stem through which smoke is drawn, the assembly being fitted in a top opening of the upper chamber for apparatus-generated suction, the smoke generating and conveying assembly being optionally useable in a side vent of the lower chamber for single chamber water-assisted operation of the apparatus in which the user generates the suction needed to draw the smoke into the vessel through the water.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 shows the vessel with two chambers, each chamber having a plurality of vents and legs, while FIGS. 1A and 1B show exploded and assembled views, respectively, of the smoke generating and conveying assembly used with the vessel to complete the apparatus.

DETAILED DESCRIPTION OF THE PREFERRED EMBODIMENTS

Figure 1:
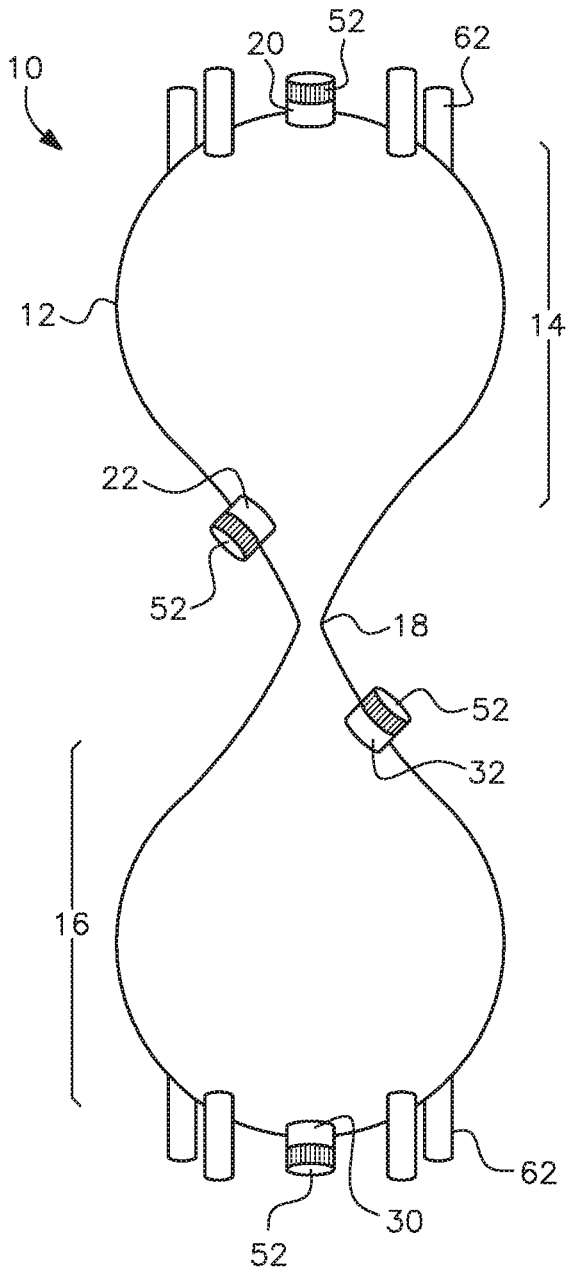
FIGS. 1, 1A and 1B show the components of a first embodiment of a water-assisted smoking apparatus in accordance with the present invention.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 1A:
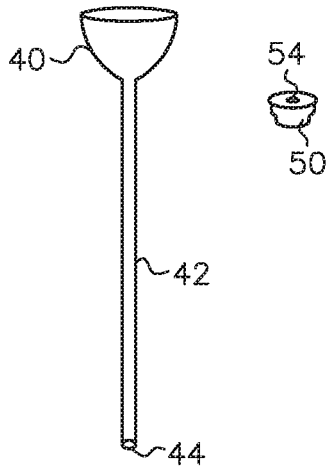
Figure 1B:
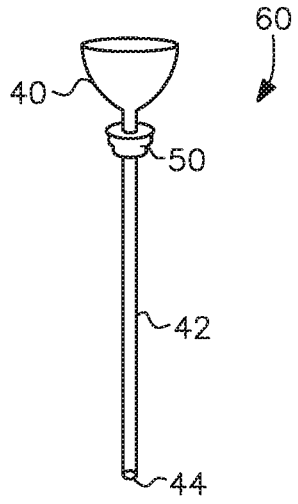

As shown by a first preferred embodiment depicted in FIGS. 1-1B and 2, the present invention is directed to a water-assisted smoking apparatus generally designated by reference numeral 10. In this regard, while the smoking apparatus is described herein as "water" assisted, it is not intended that the present invention be limited to use with just water as other liquids could be used. Therefore, unless otherwise specified, use of the term "water" is intended to include such other liquids as might be appropriately and safely used in conformity with the invention as it is described herein.

The water-assisted smoking apparatus 10 includes a vessel 12 having two chambers generally referred to as chamber A 14 and chamber B 16, and a smoke generating and conveying assembly generally designated by reference numeral 60 and shown in FIGS. 1A and 1B. In the orientation shown in FIG. 1, chamber A 14 is the upper chamber and chamber B 16 is the lower chamber. However, as will be further described hereinafter, the apparatus 10 is fully and interchangeably invertible, with appropriate changes in the placement of the smoke generating and conveying assembly 60, so that chamber A 14 may be the lower chamber and chamber B 16 may be the upper chamber. For ease of description, the orientation shown in FIG. 1 is referred to as the "first orientation" and an inverted orientation, with respect to what is shown in FIG. 1, is referred to as the "second orientation" (see FIG. 6).

In both the first and second orientations, the chambers 14, 16 are supported in substantially vertical alignment with one another and are separated by a choke point 18. As used herein, the term "choke point" is intended to include any narrowed or constricted region between the two chambers. According to the preferred embodiment illustrated in FIGS. 1-6, the vessel 12 of the apparatus 10 has an hourglass shape with two opposed symmetrical chambers 14, 16. However, other shapes may be used effectively, including the use of chambers that are not symmetrical.

Each chamber has at least two vents that may be generally referred to as a first vent and a second vent. According to the embodiment shown, and more specifically, chamber A 14 has an outer end vent or opening 20 and a side vent 22, and chamber B 16 has an outer end vent or opening 30 and a side vent 32. The vents 20, 22, 30, 32, as shown are embodied as projecting ports with apertures therein but they could be flush with the wall of the vessel chambers A and B. The outer end vents 20, 30 are so termed due to their positions on the outer "ends" of the chambers, with "outer" being understood to mean the end opposite or distal from the choke point 18. The side vents 22, 32 are preferably positioned proximal to the choke point 18, although this position may be varied so long as the side vents are not in communication with the quantity of water that is used during operation of the smoking apparatus 10.

The smoke generating and conveying assembly 60 according to the first embodiment of the apparatus 10 includes a bowl 40 with an elongated stem 42 and a sealing member 50 as shown in FIGS. 1A and 1B. The bowl 40 and stem 42 are preferably integral with one another but could be two components connected together. The bowl 40 is configured to hold a quantity of a combustible substance for burning therein, with the interior of the bowl being in fluid communication with a central channel 44 formed in the stem 42 that extends the length thereof. When the bowl 40 and stem 42 are fitted into one of the outer end vents 20, 30, the lower end 46 of the stem 42 preferably extends about three-quarters of the way into the respective chamber. The stem 42 may, however, be longer or shorter, i.e., the stem may be very short like the stem shown in connection with the second embodiment illustrated in FIGS. 7-9 as will be discussed hereinafter.

Each of the vents 20, 22, 30, 32 has at least one sealing member or plug that can be inserted into the vent aperture to seal the vent or be removed to open the same. In particular, and according to the first embodiment shown, the outer end vents 20, 30 may be fitted with the removable sealing member 50 of the smoke generating and conveying assembly 60 or with the solid plug 52. The solid plug 52 seals off the outer end vent 20, 30 of the lower chamber, such as outer end vent 30 of chamber B 16. Solid plugs 52 are also used to close the side vents 22, 32. Conversely, the removable sealing member 50 has a central bore 54 (see FIG. 1A) through which the stem 42 of the bowl 40 is inserted to assemble the smoke generating and conveying assembly 60 as shown in isolation in FIG. 1B.

Figure 2A:
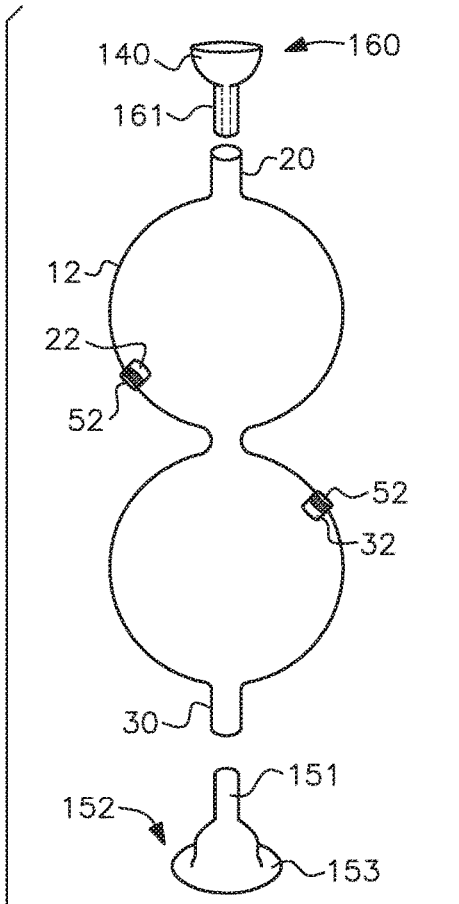
FIG. 2A is an exploded view of an alternate configuration of the water-assisted smoking apparatus in accordance with the first embodiment of the present invention.
Figure 2C:
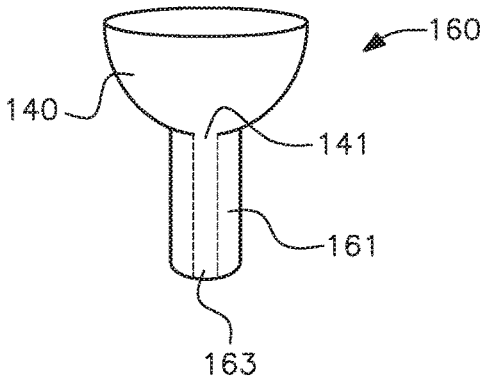
FIG. 2C is an isolated view of the smoke generating and conveying assembly shown in FIG. 2A.
Figure 2B:
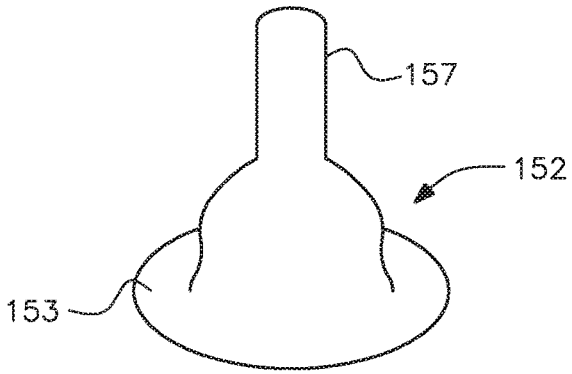
FIG. 2B is an isolated view of the end vent closing element and base shown in FIG. 2A.
Figure 2D:
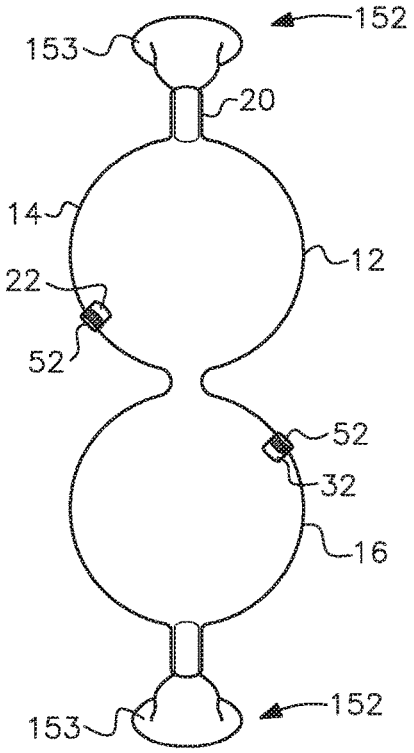
FIG. 2D is an assembled view of the alternate configuration of FIG. 2A but with both end vents fitted with an end vent closing element and base.

A preferred alternate configuration of the sealing members for the first embodiment of the apparatus according to the present invention is shown in FIGS. 2A-2D. In the alternate configuration, the end openings are sealed with an end vent closing element and base generally designated by reference numeral 152. The end vent closing element and base 152 includes an inserting end 151 that fits into the outer end openings of vents 20, 30 and a foot 153 that forms the base or pedestal upon which the apparatus can stand as shown in FIG. 2D, where the end openings on both outer end vents 20, 30 are fitted with a respective end vent closing element and base 152. The end vent closing element and base 152 is preferably unitary in structure, with the neck 151 being sized to slide into the end vents 20, 30 with friction or near friction contact with inner surfaces of the end vent openings to seal the end vent openings. The end vent closing element and base is preferably made of glass and slides in and out of the vent openings smoothly for pleasing operation when in use.

The alternate configuration also includes a modified smoke generating and conveying assembly generally designated by reference numeral 160. The assembly 160 includes a bowl 140 having a neck 161, the bowl having an opening 141 therein in communication with a central channel 163 in the neck. The neck 161 and the bowl 140 of the assembly 160 are preferably unitary in structure and also made of glass that is sized to fit into the end vent openings in the same way as the neck 151 of the end vent closing element and base 152. However, when the apparatus is in use air may be drawn into the upper chamber through the bowl opening 141 and the neck channel 163 so as to obtain air flow control in like manner as with use of the sealing member 50 and stemmed bowl already described. Specifically, when the apparatus is oriented as shown in FIG. 2D with water in the upper chamber, the end vent closing element and base 152 is simply removed and replaced with the smoke generating and conveying assembly 160 as indicated in the exploded view of FIG. 2A. When fitted in the upper chamber end vent, air and smoke pass through the bowl opening 141 and neck channel 163 to reach the interior of the apparatus when the lower chamber is vented.

It will be understood that the first embodiment works in the same way whether with the alternate configuration of the end vent closing element and base 152 or with the sealing elements 50 and 52. Therefore, operation will be described in connection with FIGS. 1, 1A, 1B, 1C and 3A-6 while bearing in mind this understanding.

Figure 1C:
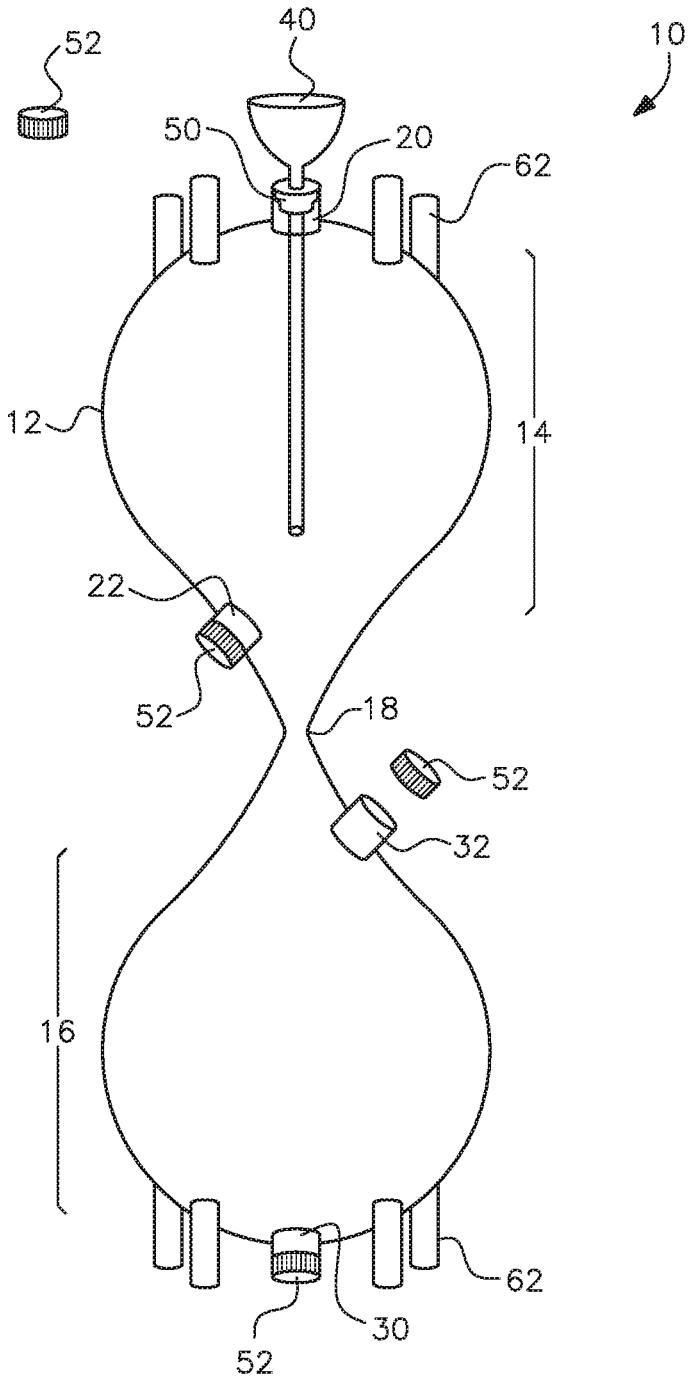
FIG. 1C shows the vessel of FIG. 1 fitted with the smoke generating and conveying assembly of FIG. 1B.
Figure 3A:
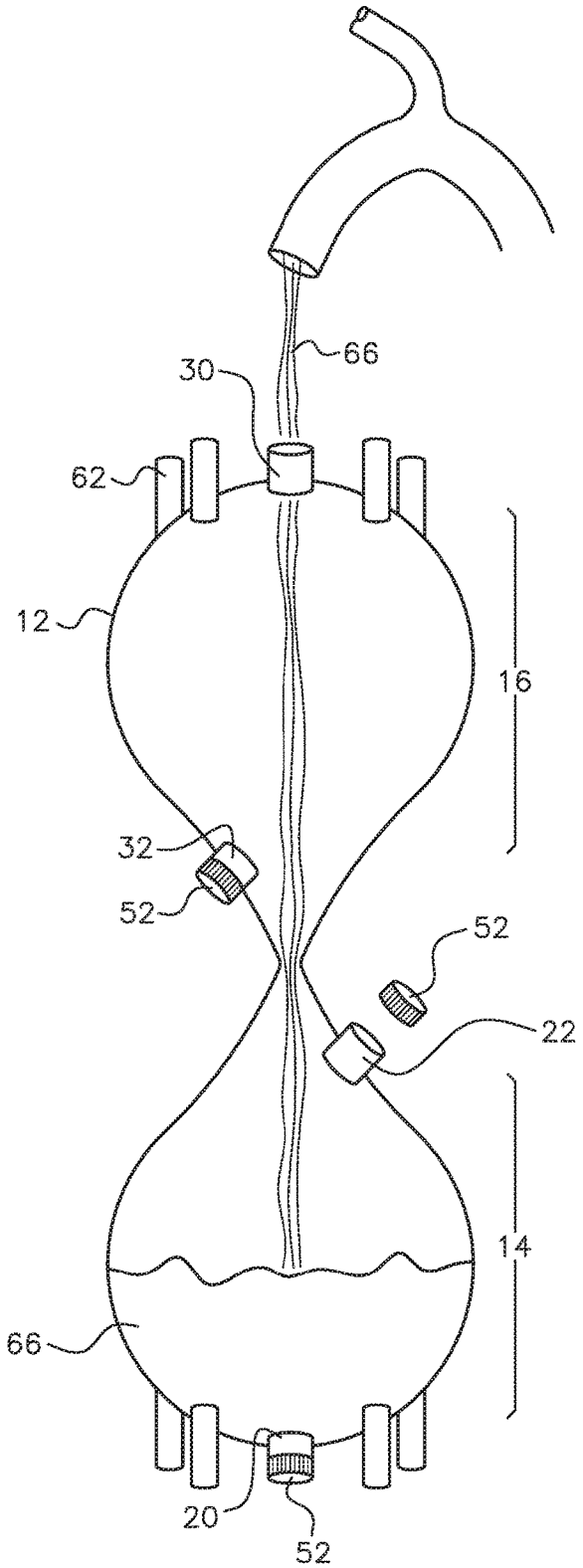
FIG. 3A shows the vessel of FIG. 1 being filled with a quantity of water according to the method of use of the present invention.
Figure 3B:
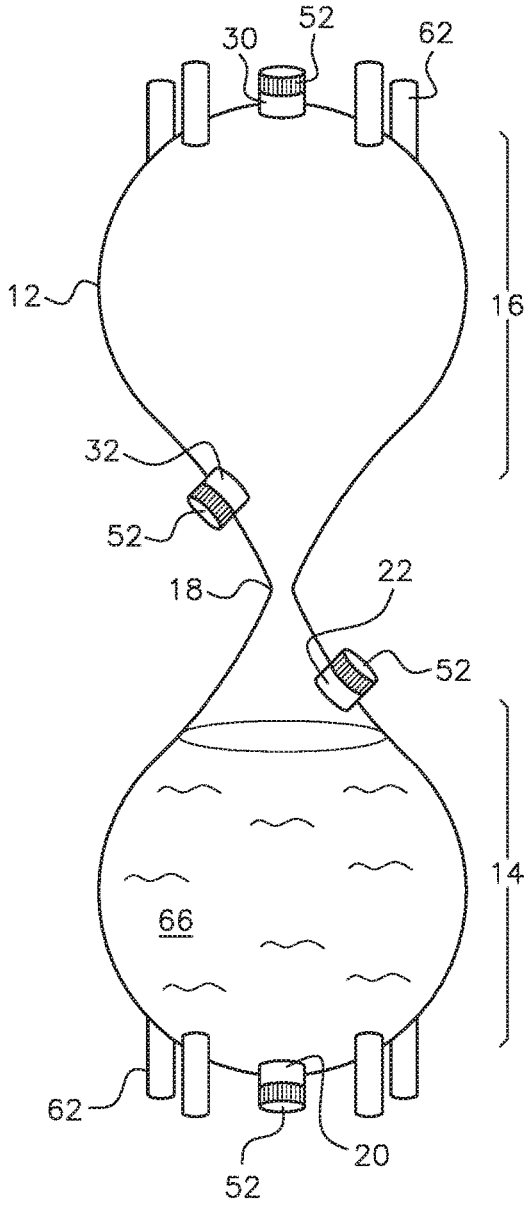
FIG. 3B shows the vessel of FIG. 3A with the desired quantity of water in the lower chamber and the top opening sealed.
Figure 3C:
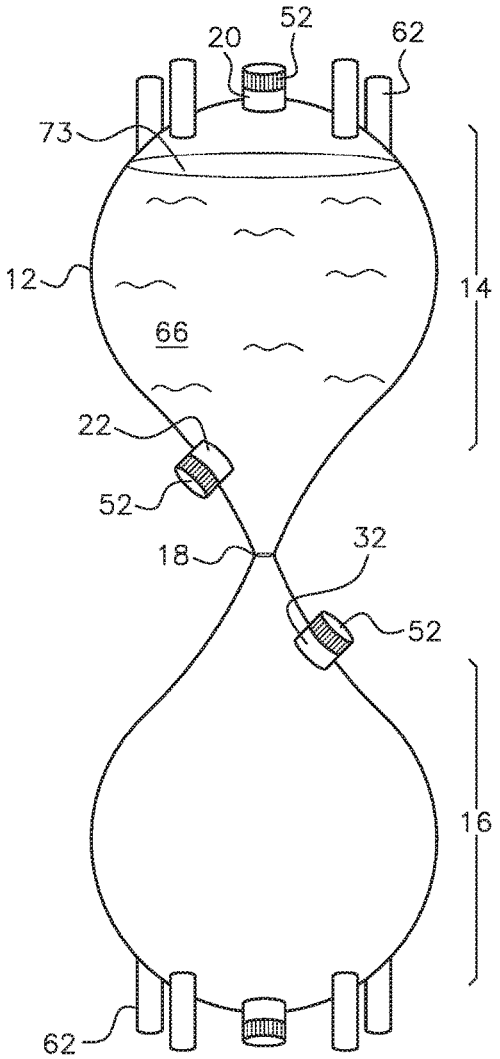
FIG. 3C shows the sealed vessel of FIG. 3B after inversion.
Figure 3D:
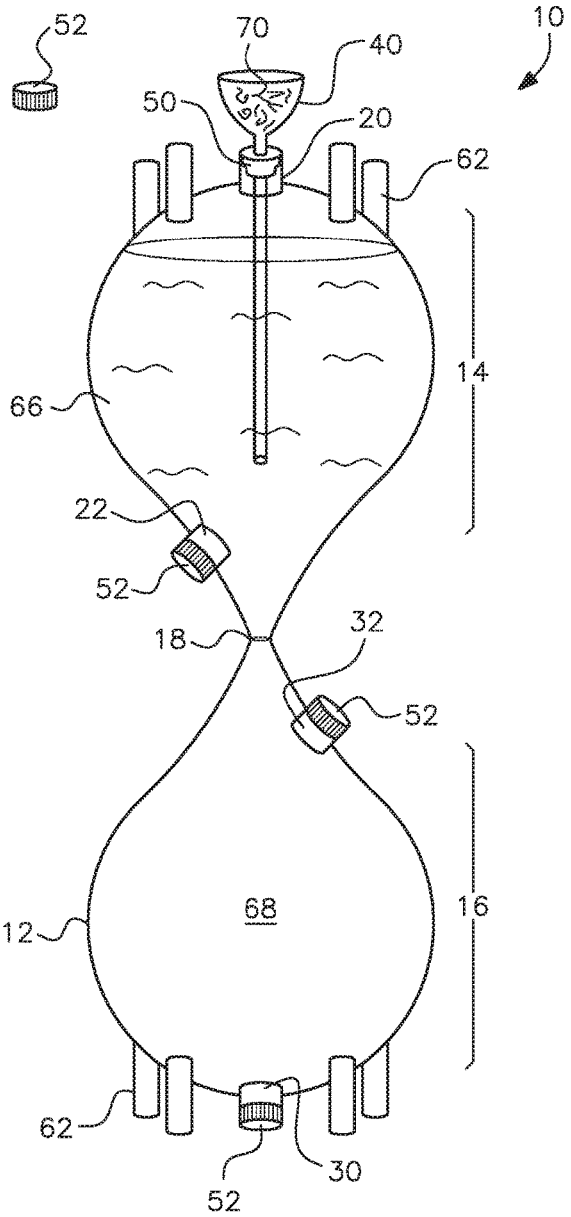
FIG. 3D shows the vessel as oriented in FIG. 3C with the top opening seal having been replaced with the smoke generating and conveying assembly containing a quantity of a combustible substance.

Hence, when the apparatus is in the first orientation prior to use, the outer end vent 30 in chamber B is fitted with a solid plug 52 while the outer end vent 20 in chamber A is fitted with the smoke generating and conveying assembly 60 as shown in FIGS. 1C and 3D. The smoke generating and conveying assembly 60 allows air to pass through the outer end vent 20, but only through the central channel 44 in the stem 42, when the sealing member 50 is pressed into a sealing engagement with the outer end vent 20 aperture and the plug 52 from the side vent 32 in chamber B 16 is removed, as in use of the apparatus when in the first orientation as will be described further hereinafter.

According to the first embodiment, the outer end of each chamber is provided with a plurality of legs or feet 62 in spaced relationship. The feet 62 enable the apparatus 10 to stand in an upright orientation when placed on a generally horizontal support surface with either of the two chambers in the lower position. Alternatively, in the absence of feet the lower chamber may be supported by a stand, perch, or other supporting cradle 64 as shown in connection with the second embodiment illustrated in FIGS. 7-9. Further, as has already been described in connection with FIGS. 2A-2D, the alternate configuration of the first embodiment uses a preferably unitary end vent closing element and base to support the apparatus.

As shown in FIGS. 3A-6, the apparatus is operable with a quantity of liquid such as water 66 which is introduced into one of the chambers in preparation for use such as by pouring water from a faucet through the end vent 30 as shown in FIG. 3A. It is noted that FIGS. 3A and 3B show the apparatus 10 inverted to the second orientation with respect to the first orientation shown in FIGS. 1 and 2 and subsequent FIGS. 3C-5. As shown in FIG. 3A, the water 66 may be poured in through the outer end vent 30 with the plug 52 removed from the side vent 22 to allow the water to flow through the choke point and into the lower chamber A, under the force of gravity, while the air previously in chamber A escapes through the open chamber A side vent 22. The amount of water may vary with the understanding that suction will only be created for as long as it takes for the water to be displaced from the upper chamber to the lower chamber. Hence, having more water prolongs the time period over which suction is created.

Once the desired quantity of water 66 has been introduced into the apparatus 10, the end vent 30 of chamber B 16 is sealed with a plug 52 as shown in FIG. 3B. The side vent 22 of chamber A 14 is also sealed with a plug 52 if the side vent 22 was opened for the pouring process. The apparatus is then inverted to the first orientation in which chamber A is the upper chamber and chamber B is the lower chamber as shown in FIG. 3C. According to the preferred embodiment shown, the choke point 18 is small enough so that, with the bottom opening 30 and both side vents 22, 32 sealed, the water in the upper chamber A will not flow into the lower chamber B. Rather, flow into the lower chamber is prevented by the air pressure in lower chamber B, the small size of the choke point, and the lack of air pressure above the upper surface 73 of the water 66 in the upper chamber A. This balance is maintained even when the solid plug 52 is removed from the top opening 20 of chamber A and replaced with the sealing member 52 fitted with the bowl 40 and stem 42, i.e., the smoke generating and conveying assembly 60, as shown in FIG. 3D.

Figure 4:
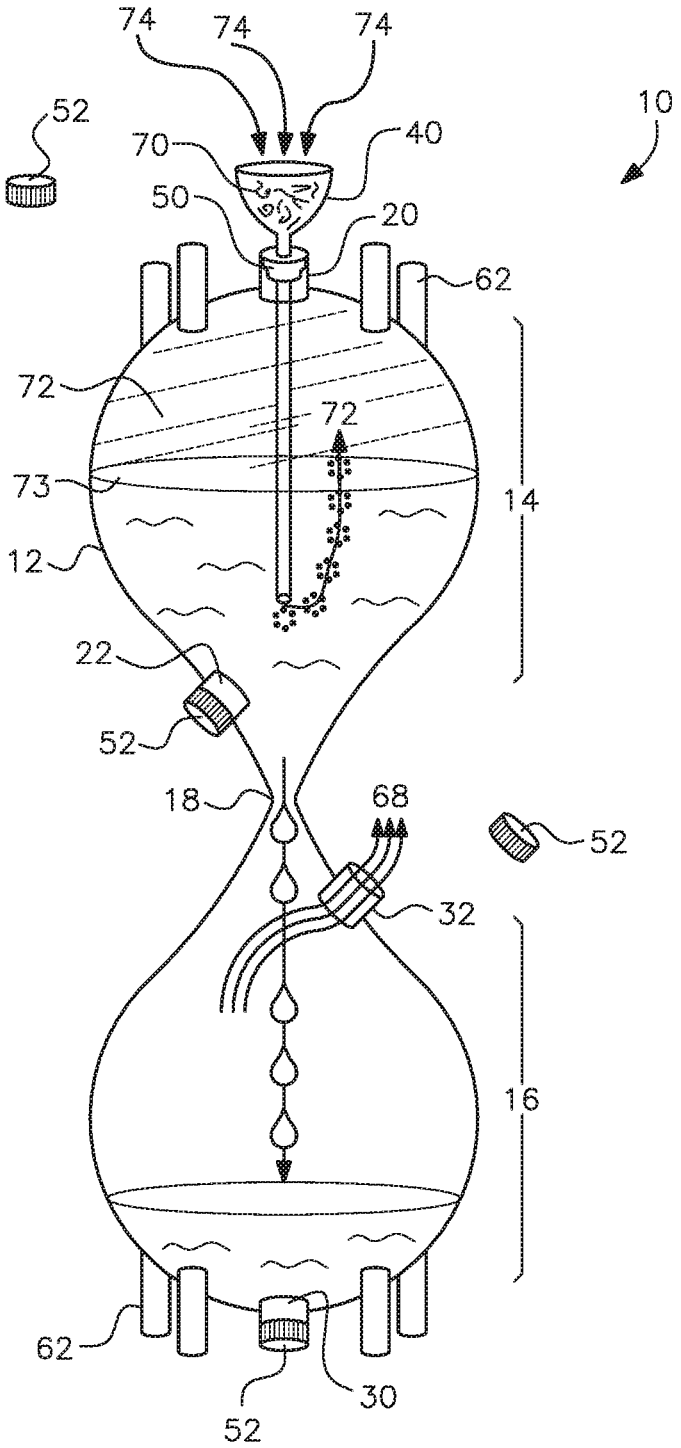
FIG. 4 shows the apparatus according to the first embodiment during use as the quantity of combustible substance in the bowl of the smoke generating and conveying apparatus is ignited and a side valve in the lower chamber is opened to allow gravity to pull the water from the upper chamber into the vented lower chamber while creating a partial vacuum in the upper chamber that draws smoke into the upper chamber of the apparatus.

With a desired quantity of combustible substance 70 having been pressed into the bowl 40 as shown in FIG. 3D, the plug 52 in the side vent 32 in the lower chamber B 16 is removed as shown in FIG. 4. Upon opening of vent 32, air 68 previously trapped in chamber B 16 exits through the open side vent 32, and the combustible substance 70 is ignited. Venting of the air 68 allows the water 66 in chamber A 14 to fall by gravity into chamber B 16 through the choke point 18. This creates a partial vacuum in chamber A 14 which draws atmospheric air 74, along with smoke 72 from the burning substance 70 in the bowl 40, into and through the central channel 44 in the stem 42 which is fitted within the sealing member 50 in the top opening 20. The smoke 72 from the burning of the combustible substance 70 goes down through the stem and, in the case of a long stem, into the water 66, creating bubbles of smoke which are filtered by the water and then burst when the bubbles meet the upper surface 73 of the water 66 to fill chamber A 14 with smoke 72. If the bowl has a short stem, the smoke is drawn into the air-filled upper portion of the upper chamber to be collected above the water line without water filtration.

Figure 5:
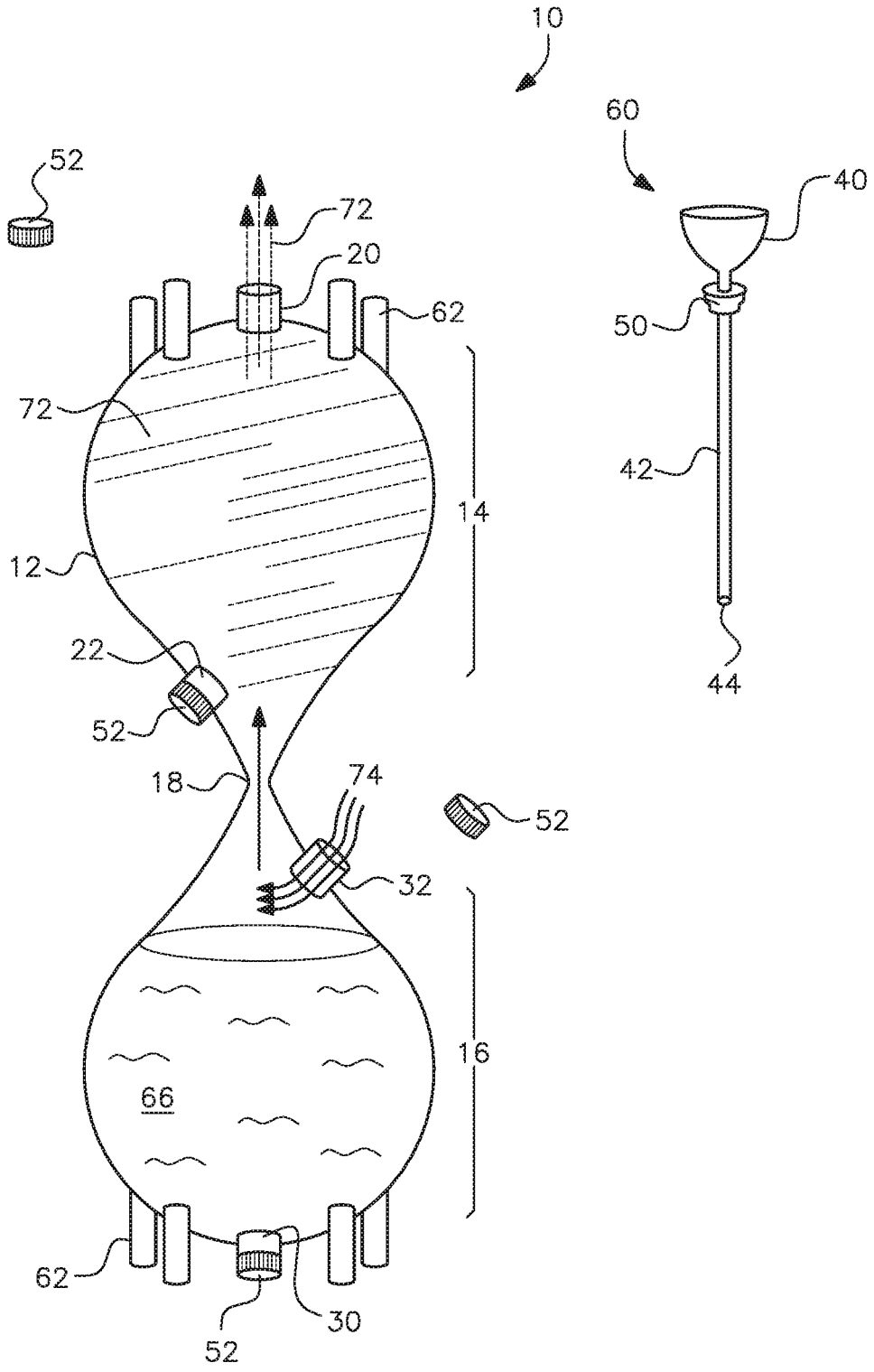
FIG. 5 shows the apparatus according to the first embodiment after all of the water has reached the lower chamber and the smoke generating and conveying assembly has been removed to allow the smoke in the upper chamber to be inhaled through the top opening.

FIG. 5 shows the apparatus 10 after the water 66 has fully transferred from the upper chamber A 14 into the lower chamber B 16 of the vessel 12 and the smoke generating and conveying assembly 66 has been removed. The user can then inhale the smoke or vapor 72 through the top opening 20 or through either of the side vents 22, 32. As the smoke 72 is inhaled, atmospheric air 74 is pulled into the vessel through an open vent, which in the case shown in FIG. 5 is vent 32, to clear the vessel.

Figure 6:
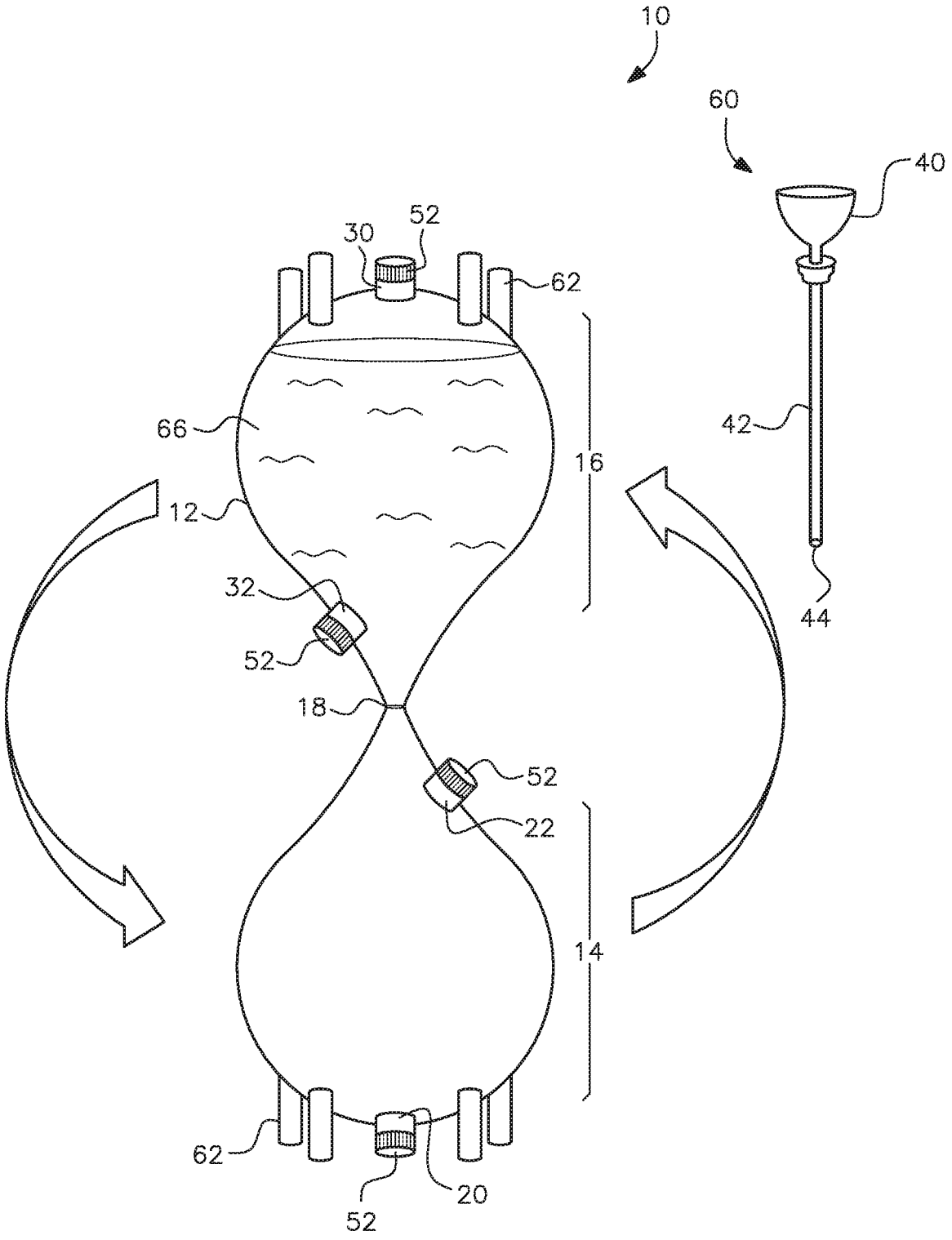
FIG. 6 shows the apparatus of FIG. 5 after the top opening and side vent have been sealed with respective plugs and the apparatus inverted for another use.

Once the smoke has been inhaled and the vessel cleared of smoke, the process may be easily repeated by sealing the side vents 22, 32 and top opening 20 with respective plugs 52 and inverting the apparatus to place chamber B 16, now filled with water 66, into the upper chamber position as shown in FIG. 6. The plug 52 in the top opening 30 may then be removed and replaced with the smoke generating and conveying assembly 60 and the bowl 40 filled with another desired quantity of combustible substance 70 to repeat the process. This inventive method allows for multiple repetitions without exchanging liquids.

Again, the foregoing description also applies to the alternate configuration shown in FIGS. 2A-2D. Therefore, references to "removal of the plug 50" or the "smoke generating and conveying assembly 60" may be similarly understood if these terms and phrases are replaced with "removal of the end vent closing element and base 152" or the "smoke generating and conveying assembly 160", respectively.

Figure 7:
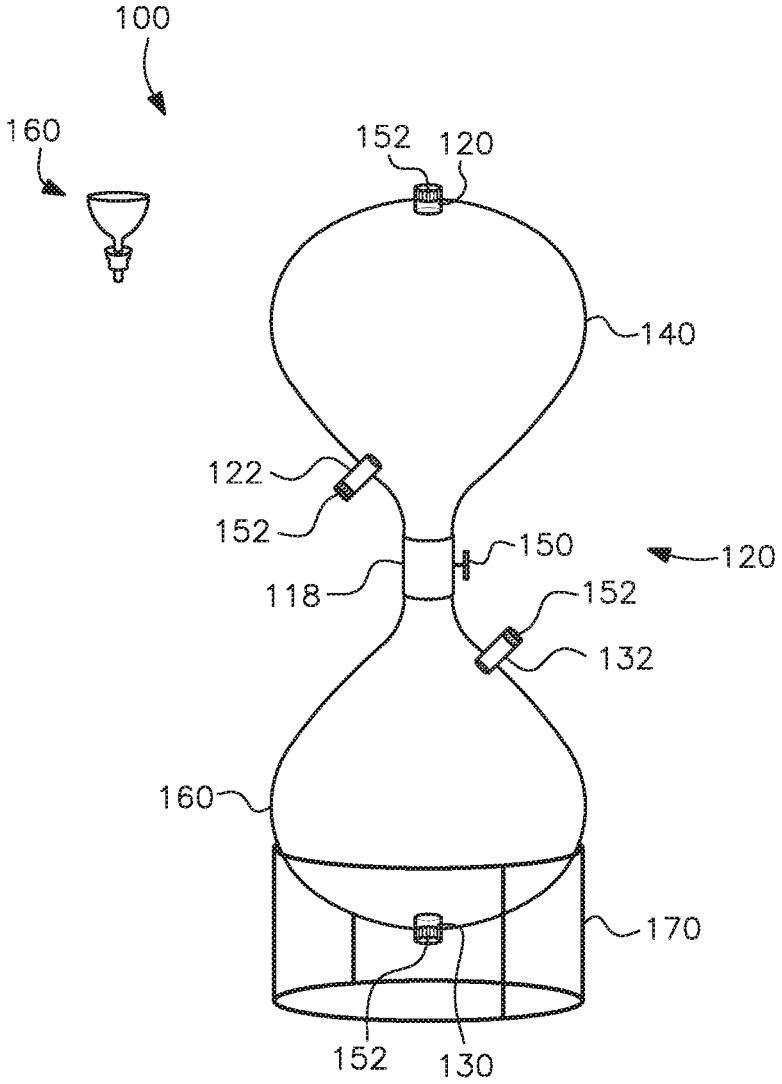
FIG. 7 shows a second embodiment of a water-assisted smoking apparatus in accordance with the present invention.
Figure 8:
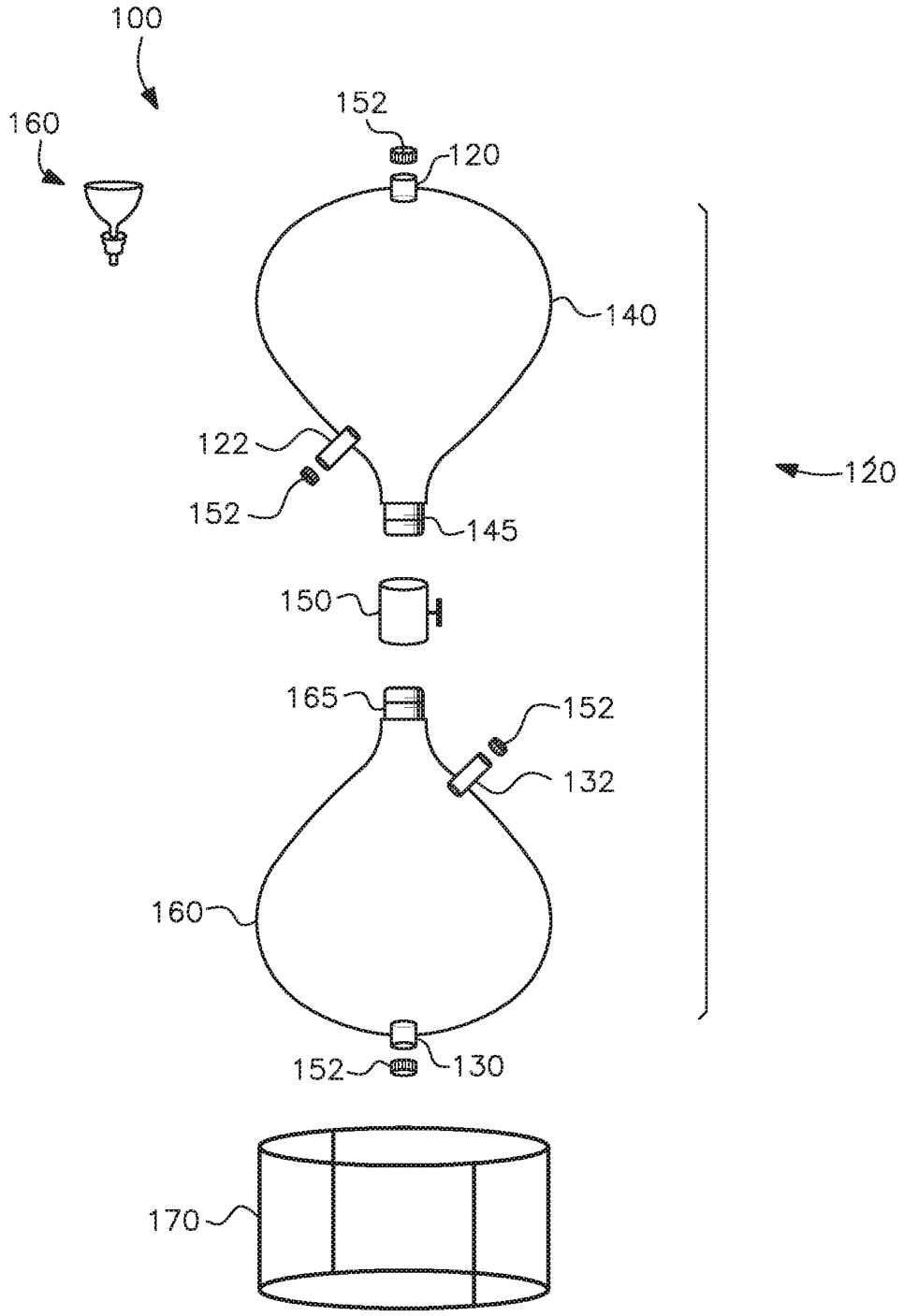
FIG. 8 is an exploded view of the components of the apparatus shown in FIG. 7.
Figure 9:
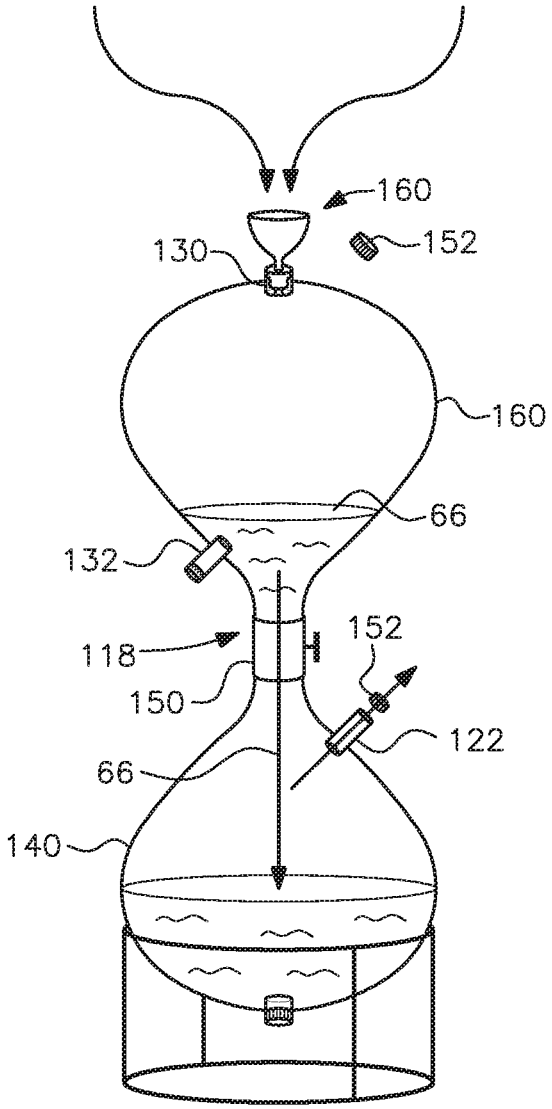
FIG. 9 shows the apparatus according to the second embodiment as assembled and during use thereof.

A second embodiment of the present invention is shown in FIGS. 7-9. The apparatus, generally designated by reference numeral 100, operates in substantially the same manner as has already been described in connection with the first embodiment. Therefore, only the differences will now be noted.

As can be seen in the exploded view of FIG. 8, the vessel, generally designated by reference numeral 120, includes two separate chambers 140, 160 joined by a valve mechanism 150 at a choke point 118. As has been described in connection with the first embodiment, the vessel 120 may be supported on a surface in either of first and second orientations, while in this second embodiment a support cradle or perch 170 is used.

As shown in the exploded view of FIG. 8, each chamber 140, 160 respectively has a valve engaging end 145, 165 and an outer end 120, 130. The sides of the chambers and the outer ends 120, 130 include vents like those already described in connection with the first embodiment. Apertures (not shown) in the valve engaging ends 145, 165 allow fluid to flow from one chamber to the other through the valve mechanism 150 when the apparatus is assembled as shown in FIGS. 7 and 9.

For use, with the chambers separated as shown in the exploded view of FIG. 8, water can be added to the lower chamber 160 through the aperture in the valve engaging end 165, after which the apparatus is assembled (see FIG. 7) by threadedly engaging the upper chamber 140, valve mechanism 150 and lower chamber 160 and closing the side and end opening vents 120, 122, 130, 132 with solid plugs 152. Alternatively, water may be added through the end opening of the upper chamber after the apparatus has been assembled, in like manner with the first embodiment.

After introducing the quantity of water, the apparatus is inverted to place chamber 160 in the upper position and the solid plug 152 previously in opening 130 is replaced with the smoke generating and conveying assembly 160, as shown in FIG. 9. With the water 66 now in the upper chamber, the plug 152 in the side vent 122 is removed and the valve mechanism 150 is opened to allow the water 66 to flow downwardly into the lower chamber 140 while drawing in and collecting smoke in the upper chamber 160 in accordance with the present invention as has already been described.

With respect to the second embodiment, the bowl is shown with a short stem such that there is no water filtration as has already been described. However, a long-stemmed bowl could also be used with the second embodiment, as could an end vent closing element and base 152 along with a smoke generating and conveying assembly 160.

The vessel is preferably made of glass although other materials such as plastic may be used. The plugs are preferably rubber or other elastomeric substance although any material or manner of closure may be used provided a good seal may be obtained. In the alternate configuration of the first embodiment, glass is preferred for the end vent closing element and base as has already been discussed. Further, while the side vents are shown with rubber or elastomeric seals 52, the side vent closures can advantageously be made as threaded caps to engage with complementary threads (not shown) on the vent openings 22, 32.

While the side vents have been described herein as fitted with removable solid plugs while the end openings can receive solid plugs or the smoke generating and conveying assembly, it should be noted that the side vents may also be used to mount the smoke generating and conveying assembly in like manner with the end openings. In this alternate configuration, the apparatus may be used with water in the lower chamber and the smoke generating and conveying assembly fitted within the side vent in the lower chamber, thereby enabling the apparatus to be used in a more conventional way as is known in the art to create a water-filtered smoking apparatus in which the user, using a vent in the upper chamber, creates the suction needed to draw smoke into the vessel of the apparatus.

As described, the apparatus according to the present invention is operable to draw in and collect smoke generated from the burning of a combustible substance when in a first orientation with the first chamber as an upper chamber and the second chamber as a lower chamber and is then operable to draw in and collect smoke from burning of another quantity of the combustible substance after being inverted to the second orientation in which the second chamber is the upper chamber and the first chamber is the lower chamber.

Figure 10:
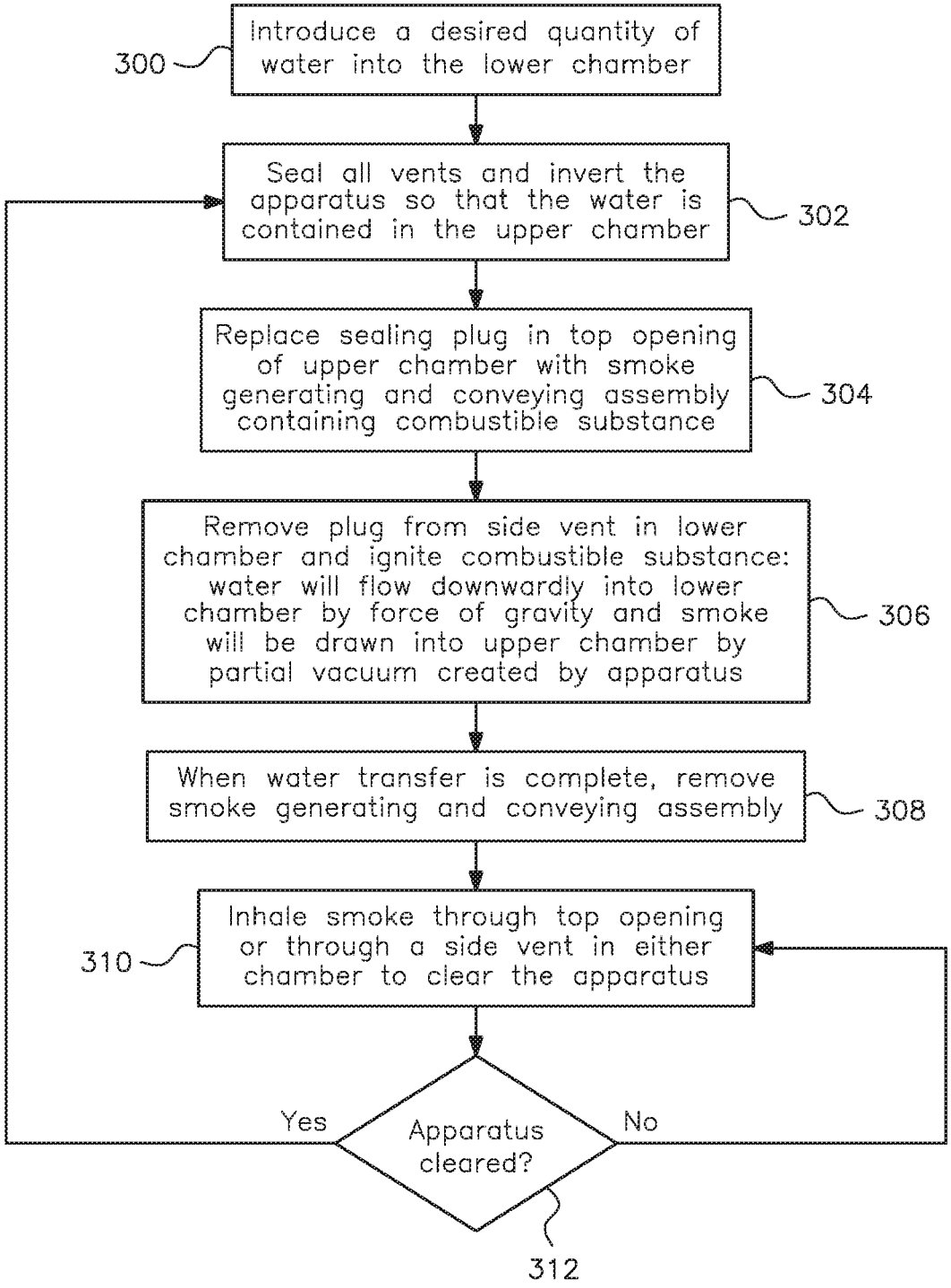
FIG. 10 is a flowchart of a method of using the water-assisted smoking apparatus according to the present invention.

More particularly, the method of using the water-assisted smoking apparatus according to the present invention includes the steps summarized in the flowchart of FIG. 10. As has already been described, the apparatus has an upper chamber and a lower chamber that are fully interchangeable through inversion of the apparatus.

Prior to the initial use of the apparatus as a water-assisted smoking apparatus, a desired quantity of water is poured into the vessel and allowed to collect in the lower chamber, step 300. Once the water is in the lower chamber, seal all the vents with solid plugs (or the end vents with an end vent closing element and base) and invert the apparatus so that the water is contained in the upper chamber, step 302. The apparatus is now ready for use in smoking.

Remove the solid plug (or end vent closing element and base) from the top opening of the upper chamber and replace it with the smoke generating and conveying assembly containing a desired quantity of a combustible substance to be smoked, step 304. Remove the plug from the side vent in the lower chamber and ignite the combustible substance, step 306. Upon venting, water will flow downwardly into the lower chamber by force of gravity and, with the combustible substance ignited, smoke will be drawn into the upper chamber by the partial vacuum which is created by the apparatus itself.

When water transfer from the upper chamber into the lower chamber is complete, remove the smoke generating and conveying assembly, step 308. The smoke in the apparatus may then be inhaled through the top opening or through the side vent in either the upper or lower chamber which will clear the apparatus, step 310.

When the apparatus is cleared, as by inhaling the smoke, step 312, the apparatus may be reused by sealing the vents and inverting the apparatus to again place the water in the upper chamber position, step 302, and repeating steps 304-312 as just enumerated. The process of burning a combustible material associated with the top opening in the upper chamber, collecting smoke through suction created by the apparatus as water flows from the upper to the lower chamber, inhaling the smoke, and inverting the apparatus for reuse may be repeated as many times as desired without delay in use of the apparatus or any need to change the water.

While the apparatus has been described herein as a water-assisted smoking apparatus, it is noted that the present invention may also be used as a wine aerator. With reference to FIG. 2D, the end vent closing element and base 152 fitted in the top opening of chamber 14 is removed and vent plug 52 removed from vent 32 to pour wine into the lower chamber 16. The wine may be poured through the top opening 20 with or without the use of bowl 140. Once the wine is in the lower chamber, the top opening is closed with the end vent closing element and base 152 and the apparatus inverted. Now inverted, and with the top opening (of chamber 16) vented, the vent plug in vent 22 is then removed (since chamber 14 is now the lower chamber) and the wine allowed to flow from the upper chamber 16 to the lower chamber 14 as air is drawn into the upper chamber through the top opening 30 (since chamber 16 is now the upper chamber). For further aeration, a long-stemmed bowl may be used so that air is drawn into, and bubbled through, the wine in the upper chamber in the same manner as has already been described in connection with FIG. 4, but of course without any combustible substance in the bowl.

Accordingly, the present invention is also intended to encompass a liquid-assisted air-moving apparatus that includes a vessel having a first chamber and a second chamber in substantially vertical alignment with one another and separated by a choke point, each chamber having at least a first vent and a second vent with the vents having respective removable closing elements for sealing thereof. The apparatus is fully invertible and operable with a quantity of liquid to create suction to draw in air when in a first orientation with the first chamber as an upper chamber and the second chamber as a lower chamber and also being operable to draw in air when inverted to a second orientation in which the second chamber is the upper chamber and the first chamber is the lower chamber. Liquid in the upper chamber is prevented from moving into the lower chamber by the choke point and air trapped in the lower chamber when the lower chamber is sealed, while air is drawn into the apparatus by movement of the liquid from the upper chamber to the lower chamber when the upper and lower chambers are vented.

As has been described in connection with the water-assisted smoking function, the liquid-assisted air-moving apparatus may further include a bowl with a stem or neck sized for sealing engagement within at least one of the vents in each chamber to allow air to enter the respective chamber via the respective vent only through a central channel in the stem or neck. The bowl may be used to help funnel in liquid, such as wine, when introducing the liquid to the apparatus, or may alternatively be configured to hold a quantity of a combustible substance for burning therein when engaged within one of the vents for use of the apparatus as a smoking tool.

For purposes of the foregoing description, and unless otherwise specified herein such as is explicitly set forth in connection with the second embodiment shown in FIGS. 7-9, the choke point is to be understood as a narrowed or constricted "waist" between the upper and lower chambers with a flow channel therethrough that of itself, i.e., without a separate valve element or mechanism associated therewith, acts to prevent liquid from flowing between the upper and lower chambers until the chambers are vented but that, upon such venting, allows the liquid to flow from the upper to lower chamber as has been described herein. The actual size of the choke point, and its associated flow channel, can differ depending upon factors including the volume of liquid in the apparatus, the type of liquid being used, the shape of the vessel, the shape of the choke point, etc.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A method of using a liquid-assisted smoking apparatus comprising:

a) providing a vessel operative with a quantity of water and including a smoke generating and conveying assembly that holds a quantity of a combustible substance for burning therein, the vessel having an upper chamber and a lower chamber in substantially vertical alignment with one another and separated by a choke point, the upper and lower chambers being interchangeable between two orientations by inverting the vessel such that the vessel works effectively in either orientation, each chamber having at least an outer end vent positioned on the chamber distally from the choke point, and a side vent, positioned on the chamber and proximal to the choke point, each of said vents having respective removable plugs for sealing and opening thereof;

b) orienting the vessel with the quantity of water in the upper chamber while all of the vents are sealed with respective plugs;

c) replacing the plug in the outer end vent of the upper chamber with the smoke generating and conveying assembly;

d) placing a desired quantity of a combustible substance to be smoked into a bowl of the smoke generating and conveying assembly if said quantity is not already in the bowl;

e) removing the plug from the side vent in the lower chamber and igniting the combustible substance, venting of the lower chamber allowing the quantity of water to flow downwardly into the lower chamber by force of gravity and, with the combustible substance ignited, the vessel drawing smoke into the upper chamber through the smoke generating and conveying assembly by a partial vacuum which is created by the vessel; and f) when water transfer from the upper chamber into the lower chamber is complete, removing the smoke generating and conveying assembly from the outer end vent of the upper chamber so that the smoke in the vessel may be inhaled through the outer end vent or through either side vent.

2. The method as set forth in claim 1, wherein step f) further comprises inhaling the smoke through the outer end vent or the upper chomber.

3. The method as set forth in claim 1, wherein step f) further comprises inhaling the smoke through one of the side vents.

4. The method as set forth in claim 2, further comprising after the step of inhaling the steps of:

g) sealing all of the vents;

h) inverting the vessel to place the quantity of water into the position of that of the upper chamber; and i) repeating steps c) through f).

5. The method as set forth in claim 1, wherein step e) further includes opening a valve in the choke point.

* * * * *